US005785179A

United States Patent [19]

Buczwinski et al.

[11] Patent Number: 5,785,179

[45] Date of Patent: Jul. 28, 1998

[54] CONTAINER FOR WET WIPES HAVING AN IMPROVED CLOSURE MECHANISM

[75] Inventors: Carey Alix Buczwinski; Todd Christopher Larson; Annamaria Serbiak, all of Appleton, Wis.; Alfred Jack Astoreca, Annandale; Peter Anthony Piscopo, Medford, both of N.J.; Richard Herman Seager, Mystic, Conn.

[73] Assignee: Kimberly-Clark Worldwide, Inc., Neenah, Wis.

[21] Appl. No.: 868,691

[22] Filed: Jun. 4, 1997

[51] Int. Cl.[6] ..... B65D 43/00; B65D 45/00

[52] U.S. Cl. ..... 206/494; 206/1.5

[58] Field of Search ..... 206/205, 209, 206/210, 581, 233, 494, 1.5, 823

[56] References Cited

U.S. PATENT DOCUMENTS

| | | | |
|---|---|---|---|
| D. 182,255 | 3/1958 | Smith | D58/12 |
| D. 311,334 | 10/1990 | Flynn et al. | D9/424 |
| D. 315,870 | 4/1991 | Perdue, Jr. et al. | D9/424 |
| D. 330,161 | 10/1992 | Schuh | D9/423 |
| D. 363,669 | 10/1995 | Pennoyer, Jr. | D9/423 |
| D. 364,563 | 11/1995 | Miller et al. | D9/423 |
| 2,735,542 | 2/1956 | Shnitzler | 206/16 |
| 2,842,178 | 7/1958 | Solomon | 150/5 |
| 3,383,009 | 5/1968 | Weikert | 220/97 |
| 3,737,067 | 6/1973 | Palson | 220/60 R |
| 3,747,802 | 7/1973 | Uroshevich | 221/63 |
| 4,079,880 | 3/1978 | Edwards | 229/45 R |
| 4,377,245 | 3/1983 | Patty | 220/336 |
| 4,522,312 | 6/1985 | Rathgeber et al. | 220/324 |
| 4,671,408 | 6/1987 | Raines et al. | 206/365 |
| 4,684,024 | 8/1987 | Ebrahim et al. | 206/464 |
| 4,730,731 | 3/1988 | Allison | 206/540 |
| 4,735,317 | 4/1988 | Sussman et al. | 206/494 X |
| 4,746,008 | 5/1988 | Heverly et al. | 206/1.5 |
| 4,787,526 | 11/1988 | Pehr | 215/216 |
| 4,890,742 | 1/1990 | Allison | 206/540 |
| 4,925,041 | 5/1990 | Pehr | 215/216 |
| 4,938,513 | 7/1990 | Gunderson | 292/80 |
| 4,971,372 | 11/1990 | Gunderson | 292/80 |
| 4,986,438 | 1/1991 | Borst | 220/315 |
| 4,989,747 | 2/1991 | Demurger | 220/324 |
| 5,033,778 | 7/1991 | Niles et al. | 292/66 |
| 5,040,680 | 8/1991 | Wilson et al. | 206/494 X |
| 5,050,737 | 9/1991 | Joslyn et al. | 206/494 |
| 5,050,762 | 9/1991 | Giorgi | 220/281 |
| 5,100,015 | 3/1992 | Vanderstuyf | 220/326 |
| 5,322,178 | 6/1994 | Foos | 220/326 |

FOREIGN PATENT DOCUMENTS

| | | | |
|---|---|---|---|
| 2 306 359 A1 | 10/1976 | France | F16B 17/00 |
| 5-338660 A | 12/1993 | Japan . | |

OTHER PUBLICATIONS

Derwent World Patent Database abstract of JP 5/338,660: Description of Yazaki Corp., "Cover Lock Structure For Relay Switch Block".

*Primary Examiner*—Jacob K. Ackun
*Attorney, Agent, or Firm*—Jeffrey B. Curtin

[57] ABSTRACT

A wet wipe container having improved single handed opening and dispensing is disclosed. The container includes a container base, a container lid hingedly connected to the base and a closure. The front of the container lid defines a convex portion which extends outwardly and which includes a recess therein. The closure is provided by a tongue projection which extends from the container base and which is configured to extend through an aperture in the recess of the front wall of the lid. The recess and tongue projection are of sufficient size to allow easy access by a user's fingers to provide single handed opening. In one embodiment, the container lid also includes a sealing wall which is configured to provide frictional engagement with the interior of the container base when the container is closed to prevent moisture from escaping.

20 Claims, 3 Drawing Sheets

CONTAINER FOR WET WIPES HAVING AN IMPROVED CLOSURE MECHANISM

BACKGROUND OF THE INVENTION

1. Field of the Invention

The present invention relates to a container for premoistened wipes. The invention particularly concerns a container for wet wipes which has an improved latching mechanism which can be operated by a single hand.

2. Description of the Related Art

Wet wipes are well known commercial consumer products which have been available in many forms. Perhaps the most common form of wet wipes has been a stack of moistened sheets which have been packaged in a plastic container. The wet wipes have been made from a variety of materials which have been moistened with a variety of suitable wiping solutions. Typically, the wet wipes have been stacked in the container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Some of the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which is wound into a roll. Such wet wipes have been used for baby wipes, hand wipes, household cleaning wipes, industrial wipes and the like.

The conventional packages which contain wet wipes, such as those described above, have typically been designed to be positioned on a flat surface such as a countertop. Such conventional packages have generally provided a plastic container or tub which provides a sealed environment for the wet wipes to ensure that they do not become overly dry. Some of the conventional packages have also been configured to provide one at a time dispensing of each wet wipe which can be accomplished using a single hand after the package has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant.

However, the opening of such conventional containers for wet wipes has not been completely satisfactory. For example, many conventional containers are not capable of being opened by a single hand or, if designed for opening by a single hand, are not easy to open with a single hand for all users. In such containers, the user typically has to open the package with both hands before dispensing a wet wipe. Many of such containers have been hard to open because they have included a cover which provides a positive frictional seal with the container body when closed to ensure that the wet wipes do not become overly dry. In addition, many conventional containers have included relatively small opening mechanisms which are difficult to manipulate with a single hand.

Accordingly, it remains desirable to provide an aesthetically pleasing container for wet wipes which provides improved opening and dispensing while not allowing excessive escape of moisture. In particular, it remains desirable to provide a container for wet wipes which provides single handed opening and one at a time, single handed dispensing. Such an improved container is particularly desirable for baby wipes to allow the user to freely use the other hand in the diaper changing routine.

SUMMARY OF THE INVENTION

In response to the difficulties and problems discussed above, a new container for wet wipes which has improved opening and dispensing has been discovered.

In one aspect, the present invention relates to a wet wipe container which includes a container base, a container lid which is pivotally connected to the container base and a closure which is configured to releasably lock the container lid onto the container base in a closed position. The closure includes an elongated tongue projection which is connected to and extends outwardly from a front wall of the container base and a recess which is located in a convex portion of a front wall of the container lid which extends convexly outward. The recess defines a length of at least about 2.5 centimeters, a depth of at least about 1.0 centimeters and an aperture through which the tongue projection extends when the container is in the closed position. The recess also defines a resiliently flexible lip member which extends along a portion of an outer periphery of the aperture and which is configured to flex outwardly to direct the tongue projection into the aperture and snap in position under the tongue projection when the container lid is closed.

In another aspect, the present invention relates to a wet wipe container which includes a container base, a container lid and a closure. The container base defines a bottom and a front wall, rear wall, and pair of opposed side walls which extend upwardly from the bottom in a rectangular configuration to provide an interior for containing the wet wipes. The container lid is pivotally connected to the container base and defines a top and a front wall, rear wall and pair of opposed side walls which extend downwardly from the top in a rectangular configuration. The front wall of the container lid includes a convex portion which extends convexly outwards. The closure is configured to releasably lock the container lid onto the container base in a closed position. The closure includes an elongated tongue projection which extends upwardly and outwardly from the front wall of the container base and which defines a length of at least about 2.0 centimeters, a width of at least about 0.8 centimeters and a shoulder. The container also includes a recess in the convex portion of the container lid. The recess defines a depth of at least about 1.0 centimeters, an aperture through which the tongue projection extends when the container is in the closed position, and a flexible lip member along an outer periphery of the aperture. The flexible lip member is configured to flex outwardly to accept the tongue projection and snap in position under the shoulder of the tongue projection when the container lid is closed.

In yet another aspect, the present invention relates to a wet wipe container which includes a container base, a container lid, a sealing wall and a closure. The container base defines a bottom and a front wall, rear wall, and pair of opposed side walls which extend upwardly from the bottom to provide an interior for containing the wet wipes. The container lid is pivotally connected to the container base and defines a top and a front wall, rear wall and pair of opposed side walls which extend downwardly from the top. The front wall of the container lid includes a convex portion which extends convexly outwards. The sealing wall extends downwardly from the container lid and is configured to provide frictional engagement with a periphery of the interior of the container base when the container lid is in a closed position to provide a hermetically sealed environment for the wet wipes. The closure is configured to releasably lock the container lid onto the container base in the closed position after use. The closure includes an elongated tongue projection which is connected to and extends outwardly from the front wall of the container base and a recess in the convex portion of the container lid which defines an aperture through which the tongue projection extends in a locking relationship when the container is in the closed position.

Thus, the present invention, in its various aspects, advantageously relates to a container for wet wipes which, when compared to conventional containers of wet wipes, provides convenient single handed access to the wet wipes. In particular, the present invention provides an aesthetically pleasing container for wet wipes which provides a snap closure system which is large enough to allow easy access of a user's fingers. Such an improved closure system provides reliable single handed opening and dispensing for improved consumer acceptance. Such containers are particularly desirable for baby wipes intended for use in the conventional diaper changing routine where typically only one of the hands of the care-giver is available for retrieval of a wet wipe.

BRIEF DESCRIPTION OF THE DRAWINGS

The present invention will be more fully understood and further advantages will become apparent when reference is made to the following detailed description of the invention and the accompanying drawings. The drawings are merely representative and are not intended to limit the scope of the claims.

DETAILED DESCRIPTION OF THE INVENTION

Figure 1:
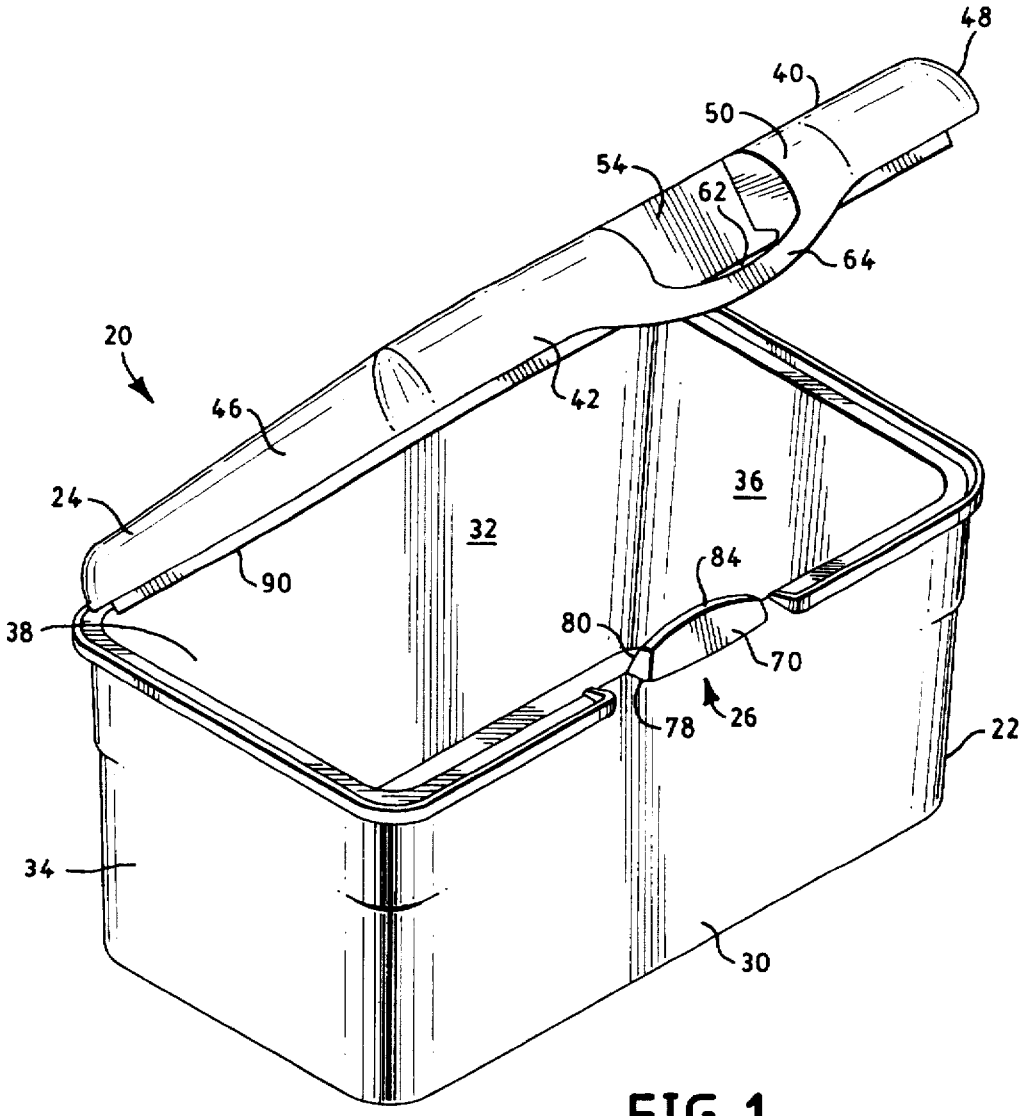
FIG. 1. representatively shows a perspective view of an example of a container for wet wipes according to the present invention.
Figure 2:
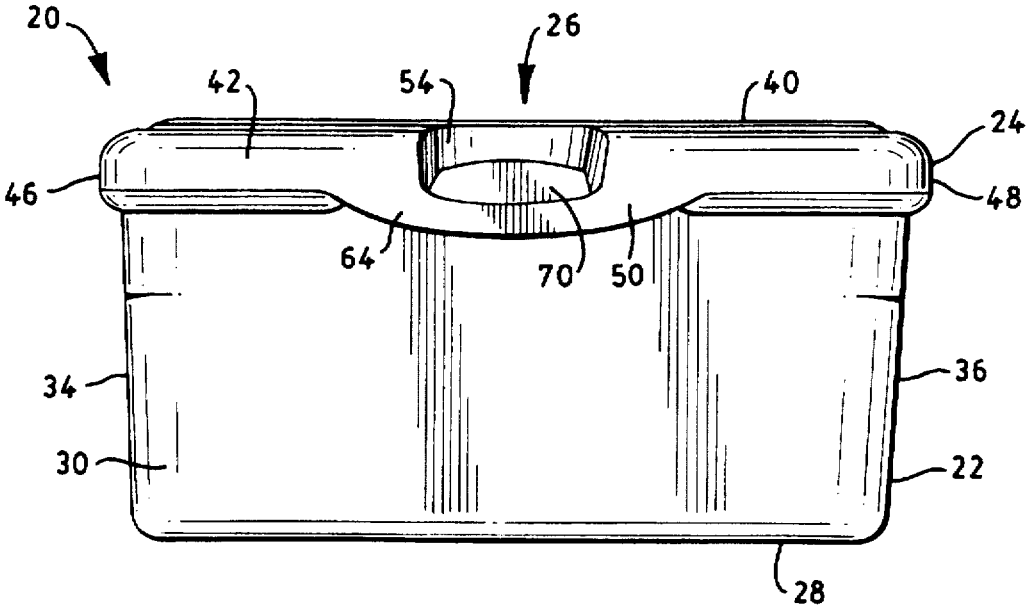
FIG. 2. representatively shows a front elevational view of the container for wet wipes illustrated in (FIG. 1.
Figure 3:
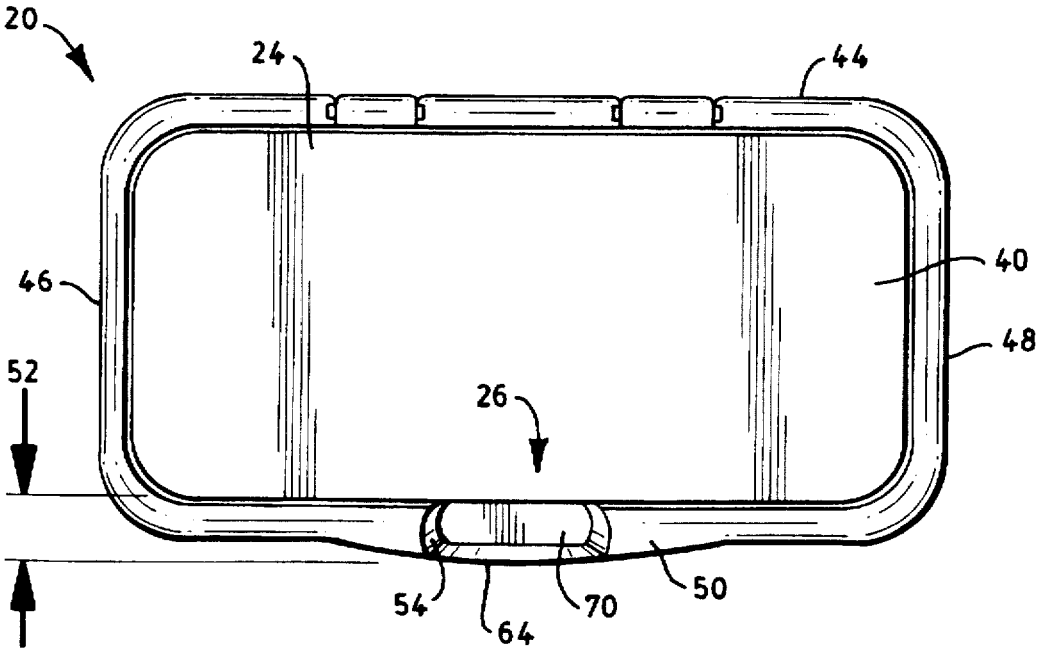
FIG. 3. representatively shows a top plan view of the container for wet wipes illustrated in (FIG. 1.

The present invention relates to a container for wet wipes which has improved single-handed opening and dispensing.

The present invention is directed at solving the convenience problems related to the use of conventional containers for wet wipes which have been difficult to use with a single hand. As representatively illustrated in FIGS. 1–5, the present invention provides a wet wipe container 20 which is configured to dispense wet wipes in a convenient and reliable manner for personal use. The wet wipe container 20 includes a container base 22, a container lid 24 which is pivotally connected to the container base 22, and a closure 26 which is configured to releasably lock the container lid 24 onto the container base 22 in a closed position. The closure 26 is configured to provide a sealing relationship between the container base 22 and container lid 24 to prevent the escape of moisture from the container 20 between uses. In a particular configuration, the container 20 may also include a sealing wall 90 to provide a hermetically sealed environment in the interior of the container 20 when the container lid 24 is closed.

The wet wipes may be arranged in the container 20 in any manner which provides convenient and reliable one at a time dispensing and which ensures that the wet wipes do not become overly dry. For example, the wet wipes may be arranged in the container 20 as a plurality of individual sheets arranged in a stacked configuration to provide a stack of wet wipes which may or may not be individually folded. The wet wipes may be individual wet wipes which are folded in a c-fold or z-fold configuration as are known to those skilled in the art and then stacked on top of each other to provide the stack of wet wipes. Alternatively, if the wet wipes are to be arranged in a stacked configuration in the container 20, the individual wet wipes may be interfolded such that the leading and trailing end edges of successive wipes in the stacked configuration overlap. In such a configuration, the leading end edge of the trailing wet wipe is loosened from the stack by the trailing end edge of the leading wet wipe as the leading wet wipe is removed by the user. The wet wipes may be interfolded to facilitate such dispensing by means known to those skilled in the art.

Alternatively, the wet wipes may be arranged in the container 20 as a continuous web of interconnected wet wipes which are folded in an accordion-like stacked configuration. The individual wet wipes may be connected together along lines of frangibility, such as lines of perforations, to ensure that the trailing wet wipe is in position for grasping by the user after the leading wet wipe is removed. For example, the wet wipes may be provided by a continuous web of material which has a series of lines of frangibility extending across the width of the web. The portion of the web of material between successive lines of frangibility provides each individual wet wipe. The lines of frangibility may be provided by means known to those skilled in the art such as perforations, indentations or cuts in the web of material. For example, the lines of frangibility or perforations may be provided in the web of material by passing the web of material between a die cutter roll and anvil roll. After the lines of frangibility have been incorporated into the web of material, the web may then be arranged in a stacked configuration for easy insertion into the interior 38 of the container 20.

The wet wipe container 20 of the present invention can comprise any suitable number of individual wet wipes depending upon the desired packaging and end use. For example, the container 20 may be configured to include a stack of wet wipes which may include at least about 5 wet wipes and desirably from about 16 to about 320 individually wet wipes.

Each wet wipe is generally rectangular in shape and defines a pair of opposite side edges and a pair of opposite end edges which may be referred to as a leading end edge and a trailing end edge. The leading end edge of each wet wipe is typically positioned in the container 20 to be grasped by a user to facilitate a removal of the wet wipe from the container 20. Each wet wipe defines an unfolded width and an unfolded length. The wet wipe may have any suitable unfolded width and length. For example, the wet wipe may have an unfolded length of from about 2.0 to about 80.0 centimeters and desirably from about 10.0 to about 25.0 centimeters and an unfolded width of from about 2.0 to about 80.0 centimeters and desirably from about 10.0 to about 45.0 centimeters.

Materials suitable for the wet wipes of the present invention are well known to those skilled in the art. The wet wipes can be made from any material suitable for use as a moist wipe, including meltblown, coform, air-laid, bonded-carded web materials, hydroentangled materials and the like and can comprise synthetic or natural fibers or combinations thereof. The wet wipes may have a basis weight of from about 25 to about 120 grams per square meter and desirably from about 40 to about 90 grams per square meter.

In a particular aspect, the wet wipes may comprise a coform basesheet of polymeric microfibers and cellulosic fibers having a basis weight of from about 60 to about 80 grams per square meter and desirably about 75 grams per square meter. Such coform basesheets are manufactured generally as described in U.S. Pat. No. 4,100,324 to Anderson et al. which issued Jul. 11, 1978, and which is herein incorporated by reference. Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet may comprise from about 20 to about 100 weight percent, desirably from about 20 to about 60 weight percent, and more desirably from about 30 to about 40 weight percent of polymeric microfibers based on the dry weight of the coform basesheet being used to provide the wet wipes.

The wet wipes of the different aspects of the present invention contain a liquid which can be any solution which can be absorbed into the wet wipes. The liquid contained within the wet wipes may include any suitable components which provide the desired wiping properties. For example, the components may include water, emollients, surfactants, preservatives, chelating agents, pH buffers or combinations thereof. The liquid may also contain lotions and/or medicaments.

The amount of liquid contained within each wet wipe may vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 250 to about 450 weight percent liquid based on the dry weight of the wipe for improved wiping. In a particular aspect wherein the wet wipe is made from a coform material comprising from about 30 to about 40 weight percent polymeric microfibers based on the dry weight of the wipe, the amount of liquid contained within the wet wipe is from about 300 to about 400 weight percent and desirably about 330 weight percent based on the dry weight of the wet wipe. If the amount of liquid is less than the above-identified range, the wet wipes may be too dry and may not adequately perform. If the amount of liquid is greater than the above-identified range, the wet wipes may be oversaturated and soggy and the liquid may pool in the bottom of the container.

As illustrated in FIGS. 1–5, the wet wipe container 20 includes a container base 22 which defines a bottom 28 which is connected to a front wall 30, a rear wall 32, and a pair of opposed side walls 34 and 36 . The front , rear and side walls extend upwardly from the bottom 28 in a generally perpendicular manner to form a rectangular container base 22. The bottom and front, rear and side walls of the container base 22 generally define an open interior 38 for containing the wet wipes.

As illustrated in FIGS. 1–5, the wet wipe container 20 also includes a container lid 24 which defines a top 40 which is connected to a front wall 42, a rear wall 44, and a pair of opposed side walls 46 and 48. The front, rear and side walls extend downwardly from the top 40 in a generally perpendicular manner to form a rectangular container lid 24.

The container base 22 and container lid 24 of the container 20 may be provided by a variety of materials which are inexpensive and capable of retaining liquids. Suitable materials include polypropylene, polyethylene, polystyrene and the like or combinations thereof. For example, the container base 22 and container lid 24 may be manufactured from a polypropylene material which de fine s a thickness of from about 0.05 to about 2.0 millimeters.

The walls 30, 32, 34 and 36 of the container base 22 may be integral with the bottom 28 or may include separate members which are connected or joined to the bottom 28 to provide the container base 22. Similarly, the walls 42, 44, 46 and 48 of the container lid 24 may also be integral with the top 40 or may include separate members which are connected or joined to the top 40 to provide the container lid 24. Desirably, the connections or corners between the walls and the top and bottom of the base and lid are curvilinear to provide a more aesthetically pleasing container 20.

The different components of the container 20 may be provided by conventional forming means such as thermoforming or injection molding techniques known to those skilled in the art. Desirably, the container base 22 and container lid 24 are provided as integral units which are provided by injection molding techniques. Using injection molding techniques to provide the container of the present invention results in a more aesthetically pleasing container which has an improved fit between the lid 24 and base 22 for improved sealing.

As representatively illustrated in FIGS. 1–5, the container 20 also includes a closure 26 which is configured to releasably lock the container lid 24 onto the container base 22 in a closed position when not in use. The closure 26 includes an elongated tongue projection 70 which is connected to the front wall 30 of the container base 22. The tongue projection 70 extends outwardly from the container base 22 and is configured to releasably engage the container lid 24.

To provide such releasable engagement, at least a portion of the front wall 42 of the container lid 24 extends convexly outward to provide a convex portion 50. As illustrated, the convex portion 50 includes a recess 54 which includes an aperture 62 therein through which the tongue projection 70 is configured to extend when the container lid 24 is closed. The recess 54 further defines a flexible lip member 64 which extends along the outer periphery of the aperture 62. The lip member 64 is configured to flex outwardly to accept the tongue projection 70 and snap in position under a shoulder 78 of the tongue projection 70 when the container lid 24 is closed.

As discussed above, many conventional containers have not provided reliable single handed opening and dispensing. The configuration and size of the different components of the closure 26 of the container 20 of the present invention are configured to provide such reliable single handed opening. The user may open the container 20 of the present invention using a single hand by placing a thumb in the recess 54 on top of the tongue projection 70 and a forefinger under the flexible lip member 64 and exerting a downward pressure on the tongue projection 70 with the thumb while simultaneously exerting an upward and outward force on the lip member 64 with the fingers thereby causing the lip member 64 to flex outwardly to release the tongue projection 70 and open the container lid 24. In such a manner, the user's thumb is generally placed on the tongue projection 70 in a parallel relationship with the front wall 42 of the container lid 24. When opening the container 20 in such a manner, the size of the recess and tongue projection allows the user to use at least a portion of the length of the thumb on top of the tongue projection which provides the user improved control of the container 20 and the ability to exert the necessary downward force on the tongue projection 70.

Alternatively, the user may open the container using a single hand by placing the ends of one or more index fingers in the recess 54 on top of the tongue projection 70 and the thumb under the flexible lip member 64 and exerting a downward pressure on the tongue projection 70 with the fingers while simultaneously exerting an upward and outward force on the lip member 64 with the thumb thereby causing the lip member 64 to flex outwardly to release the tongue projection 70 and open the container lid 24. In such a manner, the user typically will use two or more fingers placed on the tongue projection 70 in a perpendicular relationship with the front wall 42 of the container lid 24. When opening the container 20 in such a manner, the size of the recess and tongue projection allows the user to use two fingers on top of the tongue projection which provides the user improved control of the container 20 and the ability to exert the necessary downward force on the tongue projection 70. Although, the container 20 is configured to provide such single-handed opening for the caregiver, the coordination required to operate the closure is sufficient to restrict access by infants and young children.

To provide sufficient space for the thumb or fingers of the user to effect such single handed opening, the convex portion 50 of the front wall 42 of the container lid 24 extends outwardly from the front wall 30 of the container base 22 a sufficient distance 52 such that the recess 54 readily accepts the fingers of the user. For example, it is desirable that the convex portion 50 of the front wall extend outwardly a distance 52 of at least about 1.0 centimeters and more desirably at least about 1.4 centimeters. Such a distance 52 allows for the provision of a large recess which is easier for the user to access. Such a distance 52 also allows the user improved access under the flexible lip member 64.

The size and shape of the recess 54 are configured to provide improved single handed opening and closure of the container 20. As representatively illustrated in FIGS. 4 and 5, the recess 54 in the convex portion 50 of the front wall 42 of the container lid 24 defines a length 56, a depth 58 and a height 60 which are sufficient to provide access to the thumb or fingers of the user. For example, the recess 54 may define a length 56 of at least about 2.5 centimeters and desirably at least about 4.0 centimeters, a depth 58 of at least about 1.0 centimeters and desirably at least about 1.3 centimeters, and a height 60 of at least about 1.0 centimeters and desirably at least about 1.3 centimeters for improved access.

The size and shape of the tongue projection 70 are also configured to provide improved single handed opening and closure of the container 20. As representatively illustrated in FIGS. 4 and 5, the tongue projection 70 on the front wall 30 of the container base 22 defines a length 72, a width 74 and a height 76 which are sufficient to provide sufficient surface for the thumb or fingers of the user. For example, the tongue projection 70 may define a length 72 of at least about 2.0 centimeters, desirably at least about 3.0 centimeters and more desirably at least about 4.0 centimeters, a width 74 of at least about 0.8 centimeters and desirably at least about 1.0 centimeters, and a height 76 of at least about 0.8 centimeters and desirably at least about 1.0 centimeters for improved access. The aperture 62 in the recess 54 in the front wall 42 of the container lid 24 is slightly larger in size than the tongue projection 70 such that the tongue projection 70 is capable of extending through the aperture when the container 20 is being closed. If the size of the recess 54 and tongue projection 70 are too small, it is difficult for the user to access the closure 26 and open the container 20 with a single hand.

Figure 4:
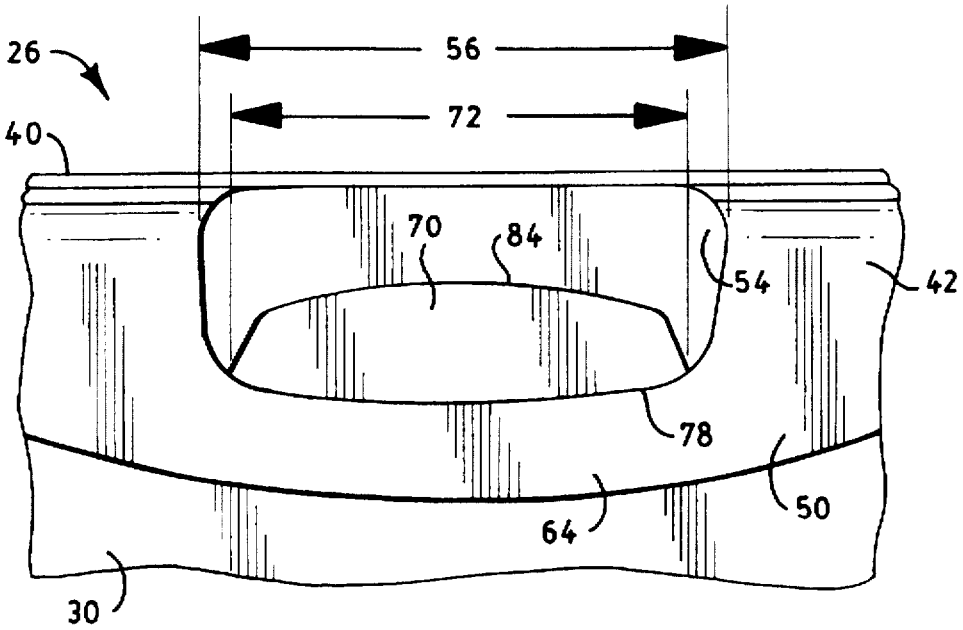
FIG. 4. representatively shows an expanded front elevational view of the closure mechanism in the container for wet wipes illustrated in FIG. 2.
Figure 5:
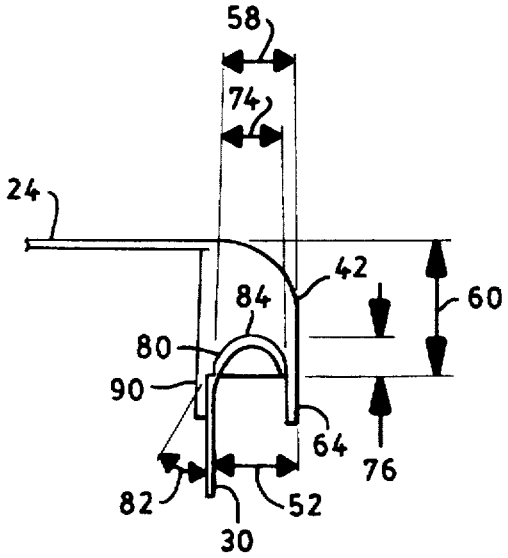
FIG. 5. representatively shows a cross sectional view of the closure mechanism in the container illustrated in FIG. 4 taken along line 5—5.

As representatively illustrated in FIGS. 4 and 5, the tongue projection 70 desirably defines a shoulder 78 which is configured to snap in place on top of the flexible lip member 64 of the container lid 24 when the container 20 is closed. The configuration of the tongue projection and the shoulder thereof provide an audible sound when the container lid 24 is securely closed which reassures the user or care giver that the container 20 is sufficiently closed to prevent the escape of moisture therefrom. The tongue projection 70 also defines an inner surface 80 which faces the interior 38 of the container 20 and an upper surface 84. As illustrated in FIG. 5, the inner surface 80 of the tongue projection 70 may extend outwardly at an angle 82 relative to the front wall 30 of the container base 22. For example, the inner surface 80 may extend outwardly at an angle 82 of from about 5 to about 35 degrees and desirably at least about 15 degrees. In such a configuration, the inner edge of the aperture 62 in the recess 54 of the container lid 24 may slidingly contact the angled inner surface 80 of the tongue projection 70 when the container is being closed to direct the tongue projection into the aperture for more reliable closure. As illustrated, the upper surface 84 of the tongue projection 70 is desirably curved to provide a smooth, pleasing surface for contact by the hand of the user.

The tongue projection 70 may be may be integral with the front wall 30 of the container base 22 or may include a separate member which is connected or joined to the front wall 30. Desirably, the tongue projection 70 is hingedly connected to the front wall 30 of the container base 22 such that the tongue projection 70 can resiliently pivot to provide improved alignment between the tongue projection 70 and aperture 62 as the container lid 24 is closed. For example, the tongue projection 70 may be made integrally with the front wall 30 of the container base 22 in a manner which allows the tongue projection 70 to resiliently pivot about a line of connection between the tongue projection 70 and the front wall 30. Such resilient pivoting may be provide by using a resiliently flexible material such as a polypropylene material to manufacture the wall 30 and tongue projection 70.

As illustrated in FIGS. 1 and 5, the wet wipe container 20 may further include a sealing wall 90 which extends downwardly from the container lid 24. The sealing wall 90 is configured to provide frictional engagement with an inside periphery of the walls of the container base 22 when the container lid 24 is closed. For example, the sealing wall 90 may be configured to extend into the base 22 a distance of at least about 0.1 centimeters and desirably a distance of at least about 0.35 centimeters for improved sealing. Such a sealing wall 90 provides a hermetically sealed environment to prevent moisture from escaping from the interior 38 of the container 20 to ensure that the wet wipes maintain the desired levels of liquid concentration. In an alternative configuration, the sealing wall may extend upwardly from the container base 22 and be configured to provide frictional engagement with an inside periphery of the walls of the container lid 24 when the container lid 24 is closed.

The sealing wall 90 may be an integral part of the container base 22 or container lid 24 of the container 20 or may be a separate component connected to the inside periphery of the walls of the container base 22 or container lid 24. For example, as representatively illustrated in FIGS. 1 and 5, the sealing wall 90 may be integral with the container lid 24. The sealing wall 90 may include any material which is capable of providing the desired hermetical seal between the container lid and container base. Suitable materials are described above as being suitable for providing the other components of the container 20. Desirably, the sealing wall 90 is made of a resiliently flexible polymeric material which can provide a good sealing relationship with the walls of the container.

Accordingly, the different aspects of the present invention can advantageously provide containers for wet wipes which, when compared to conventional containers for wet wipes, provide improved single handed opening and dispensing. Such containers are particularly useful for dispensing baby wipes since the care giver typically only has one hand free during the diapering process. Thus, the containers for wet wipes of the present invention are reliably and easily opened by one hand of the user or care giver for improved convenience and personal hygiene.

The following Examples are presented to provide a more detailed understanding of the invention. The Examples are intended to be representative, and are not intended to limit the scope of the invention.

EXAMPLE

A qualitative research study was conducted with six minigroups each of which included a maximum of four respondents to explore container designs for baby wipes. One of the containers (Tub S) assessed was made according to the present invention as representatively illustrated in FIG. 1–5. The container 20 included an elongated tongue projection 70 connected to the front wall 30 of the container base 22. The tongue projection 70 was configured to releasably engage the container lid 24 through an aperture 62 in a recess 54 in the lid 24. As representatively illustrated in FIGS. 4 and 5, the recess 54 defined a length 56 of 4.9 centimeters, a depth 58 of 1.2 centimeters and a height 60 of 1.6 centimeters and the tongue projection 70 defined a length 72 of 4.2 centimeters, a width 74 of 1.1 centimeters and a height 76 of 1.2 centimeters.

Comparative Example

Another container assessed (Tub L) in the same qualitative research study was similar to the container of Example 1 except that the recess 54 was smaller in size and defined a length 56 of 2.2 centimeters, a depth 58 of 1.1 centimeters and a height 60 of 1.1 centimeters and the tongue projection 70 was smaller in size and defined a length 72 of 1.9 centimeters, a width 74 of 1.0 centimeters and a height 76 of 1.2 centimeters.

The respondents preferred the larger tongue projection of the container of the Example because it was easy to locate, allowed several different hand positions for opening the container, and was very easy to open compared to the container of the Comparative Example.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims and any equivalents thereto.

What is claimed is:

1. A wet wipe container which includes a container base, a container lid which is pivotally connected to said container base and a closure which is configured to releasably lock said container lid onto said container base in a closed position wherein said closure comprises:

a) an elongated tongue projection which is connected to and extends outwardly from a front wall of said container base; and b) a recess which is located in a convex portion of a front wall of said container lid which extends convexly outward wherein said recess defines a length of at least about 2.5 centimeters, a depth of at least about 1.0 centimeters, an aperture through which said tongue projection extends when said container is in said closed position, and a resiliently flexible lip member which extends along a portion of an outer periphery of said aperture and which is configured to flex outwardly to direct said tongue projection into said aperture and snap in position under said tongue projection when said container lid is closed.

2. The wet wipe container of claim 1 wherein said container base defines a bottom which is connected to said front wall of said base, a rear wall, and a pair of opposed side walls which extend upwardly from said bottom in a generally rectangular configuration to provide an interior for containing said wet wipes and wherein a connection between said bottom and said front, rear and side walls is curvilinear.

3. The wet wipe container of claim 1 wherein said container lid defines a top which is connected to said front wall of said lid, a rear wall, and a pair of opposed side walls which extend downwardly from said top in a generally rectangular configuration and wherein a connection between said top and said front, rear and side walls is curvilinear.

4. The wet wipe container of claim 1 wherein said tongue projection defines a length of at least about 2.0 centimeters and a width of at least about 0.8 centimeters.

5. The wet wipe container of claim 1 wherein said tongue projection includes an inner upwardly extending surface which is connected to said front wall of said base and extends outwardly relative to said front wall of said container base in an angular relationship.

6. The wet wipe container of claim 5 wherein said inner surface of said tongue projection extends outwardly at an angle of at least about 15 degrees relative to said front wall of said container base.

7. The wet wipe container of claim 1 wherein said tongue projection defines an upper surface which is curvilinear.

8. The wet wipe container of claim 1 wherein said tongue projection is hingedly connected to said container base and configured to resiliently pivot as said container lid is closed.

9. The wet wipe container of claim 1 wherein said convex portion of said front wall of said container lid extends outwardly a distance of at least about 1.0 centimeters from said front wall of said container base when said container is in said closed position.

10. The wet wipe container of claim 1 wherein said container comprises an injection molded polypropylene material.

11. A wet wipe container comprising:

a) a container base which defines a bottom and a front wall, rear wall, and pair of opposed side walls which extend upwardly from said bottom in a rectangular configuration to provide an interior for containing said wet wipes;

b) a container lid pivotally connected to said container base which defines a top and a front wall, rear wall and pair of opposed side walls which extend downwardly from said top in a rectangular configuration wherein said front wall of said container lid includes a convex portion which extends convexly outwards; and c) a closure which is configured to releasably lock said container lid onto said container base in a closed position wherein said closure comprises:

i) an elongated tongue projection which extends upwardly and outwardly from said front wall of said container base and which defines a length of at least about 2.0 centimeters, a width of at least about 0.8 centimeters and a shoulder; and ii) a recess in said convex portion of said container lid which defines a depth of at least about 1.0 centimeters, an aperture through which said tongue projection extends when said container is in said closed position, and a flexible lip member along an outer periphery of said aperture which is configured to flex outwardly to accept said tongue projection and snap in position under said shoulder of said tongue projection when said container lid is closed.

12. The wet wipe container of claim 11 wherein said container defines corners between said front walls, said rear walls, said side walls, said top and said bottom which are curvilinear.

13. The wet wipe container of claim 11 wherein an inner surface of said tongue projection extends outwardly at an angle of at least about 15 degrees relative to said front wall of said container base.

14. The wet wipe container of claim 11 wherein said tongue projection is hingedly connected to said front wall of said container base and configured to resiliently pivot as said container lid is closed.

15. A wet wipe container comprising:

a) a container base which defines a bottom and a front wall, rear wall, and pair of opposed side walls which extend upwardly from said bottom to provide an interior for containing said wet wipes;

b) a container lid pivotally connected to said container base which defines a top and a front wall, rear wall and pair of opposed side walls which extend downwardly from said top wherein said front wall of said container lid includes a convex portion which extends convexly outwards;

c) a sealing wall which extends downwardly from said container lid and which is configured to provide frictional engagement with a periphery of said interior of said container base when said container lid is in a closed position to provide a hermetically sealed environment for said wet wipes; and d) a closure which is configured to releasably lock the container lid onto the container base in said closed position after use wherein said closure comprises:

i) an elongated tongue projection which is connected to and extends outwardly from said front wall of said container base; and ii) a recess in said convex portion of said container lid which defines an aperture through which said tongue projection extends in a locking relationship when said container is in said closed position.

16. The wet wipe container of claim 15 wherein said walls of said container base and said sealing wall of said container lid define a rectangular configuration.

17. The wet wipe container of claim 15 wherein said sealing wall of said container lid is configured to extend downwardly along said walls of said container base into said interior of said container base a distance of at least about 0.1 centimeters when said container is in said closed position to provide said sealed environment.

18. The wet wipe container of claim 15 wherein said recess further defines a flexible lip member along an outer periphery of said aperture which is configured to flex outwardly to accept said tongue projection and snap in position under a shoulder of said tongue projection when said container lid is closed.

19. The wet wipe container of claim 15 wherein said recess further defines a length of at least about 2.5 centimeters, a depth of at least about 1.0 centimeters and a height of at least about 1.0 centimeters to readily accept a user's fingers.

20. The wet wipe container of claim 19 wherein said tongue projection further defines a length of at least about 2.0 centimeters, a width of at least about 0.8 centimeters, a height of at least about 0.8 centimeters and a rounded upper surface to readily accept a user's fingers.

* * * * *